United States Patent [19]

Schreiner et al.

[11] 4,393,359

[45] Jul. 12, 1983

[54] ELECTROMAGNETIC RELAY

[75] Inventors: Gary W. Schreiner, Sterling; Merle L. Kemp, Jr., Prophetstown, both of Ill.; Edward A. Chernoff, Brookville, N.Y.

[73] Assignee: Products Unlimited Corp., Sterling, Ill.

[21] Appl. No.: 320,323

[22] Filed: Nov. 12, 1981

[51] Int. Cl.[3] ..... H01H 51/08

[52] U.S. Cl. ..... 335/128; 335/133; 335/135

[58] Field of Search ..... 335/128, 135, 133

[56] References Cited

U.S. PATENT DOCUMENTS 3,825,865 7/1974 Prouty et al. ..... 335/128

*Primary Examiner*—Harold Broome

*Attorney, Agent, or Firm*—Edmond T. Patnaude

[57] ABSTRACT

Integral posts on the molded base limit rotation of a lower contact carrier, and a contact guide limits rotation of an upper contact carrier, the carriers being spring biased for slidable movement on a lifter post attached to the armature of the relay.

5 Claims, 4 Drawing Figures

ELECTROMAGNETIC RELAY

The present invention relates in general to a new and improved relay of the type which picks up instantaneously when the coil is energized, and it relates in particular to a novel contact assembly which has improved insulating safety characteristics and which is less expensive to manufacture than comparable relays now on the market.

BACKGROUND OF THE INVENTION

In U.S. Pat. No. 3,825,865 there is described an electro-magnetic relay of the general type to which the present invention pertains. It incorporates upper and lower contact carriers slidably mounted on a lifter post extending upwardly from the poviotable armature of the operating coil of the relay. Undesired rotation of the contact carriers on the lifter post is prevented by means of a special upstanding metal stamping attached to the armature and located between a pair of contact support brackets which also function as tab terminals.

In order to reduce the manufacturing cost of such a relay it would be desirable to eliminate the said metal stamping and the associated insulator which separates it from the upper contact carrier. The elimination of this same stamping would also reduce the possibility of undesired arcing between the contact support brackets and the armature or lifter post.

SUMMARY OF THE INVENTION

Briefly, in accordance with the present invention there is provided a new and improved relay wherein a molded base includes upstanding, integral guide posts which prevent rotation of a lower contact carrier, and an insulating guide member carried by the contact lifter post prevents rotation of the upper contact carrier.

GENERAL DESCRIPTION OF THE DRAWINGS

The present invention will be better understood by a reading of the following detailed description taken in connection with the accompanying drawings wherein.

DETAILED DESCRIPTION OF A PREFERRED EMBODIMENT OF THE INVENTION

Figure 1:
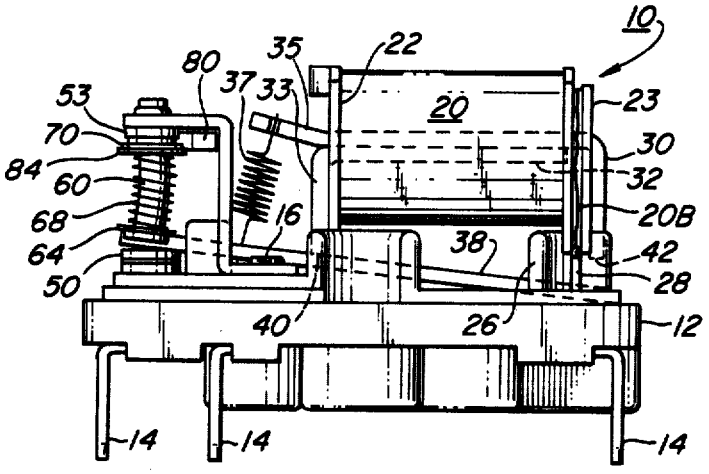
FIG. 1 is a side elevational view of an electromagnetic relay embodying the present invention.

Referring to the drawings, a relay 10 may be seen to comprise a base member or terminal block 12 to the top of which the operating parts of the relay are mounted. The base member 12 is an integral, rigid part which is molded of a suitable plastic such as phenolic. A plurality of tab-type terminals 14 are connected to the bottom of the base by means of a plurality of rivets 16 or the like. As shown, the base member 12 is provided with a pair of holes 18 for receiving mounting screws or bolts for mounting the relay to a support surface.

Figure 3:
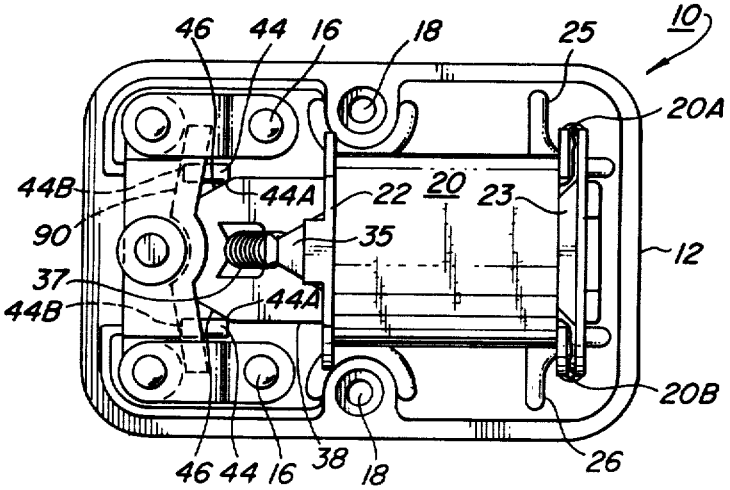
FIG. 3 is a top view of the relay of FIG. 1.

An electromagnetic coil 20 is wound on a generally tubular, insulating bobbin having front and rear end flanges 22 and 23, the latter resting on a pair of upstanding, integral brackets 25 and 26 forming parts of the base member 12. The wire end portions 20A and 20B of the coil 20 are disposed in peripheral grooves in the rear end flange 23, as best shown in FIG. 3, and are electrically connected as by soldering to a pair of posts 28 which extend through holes in the base and are soldered to the two rear terminals 14.

A set of ferromagnetic core pieces 30 and 32 extend in mutual overlying relationship through the axial opening through the bobbin around which the coil 20 is wound, and the forward end portion 33 of the member 32 extends downwardly along the front face of the flange 22 and is suitably fixed to the base member 12 to hold the coil in place. The forward end portion 35 of the core part 30 is turned up to provide a place of attachment for the upper end of a tension spring 37 which is attached at its lower end to a ferromagnetic armature 38. As may best be seen in FIG. 1, the armature 38 is a flat member which is mounted for pivotal movement about lower edge portions 40 of the core part 33. When the coil 20 is deenergized the armature is held in the position shown in FIG. 1 by the spring 37, the rear end portion of the armature being spaced from the bottom edge 42 at the rear of the core part 30. When the coil 20 is energized, the rear end portion of the armature is pulled up into engagement with the lower edge 42 to complete the magnetic circuit and causing the portion of the armature disposed forwardly of the fulcrum edges 40 to move down toward the base.

The armature is prevented from moving horizontally by the brackets 26 at the rear and by a pair of abutment guide members in the form of posts 44 near the front. The posts 44 are integral parts of the base member 12 and are generally rectangular in horizontal cross-section. The inner rear corners 44A engage the tapered side edges 46 of the armature to prevent lateral movement of the armature as it pivots up and down. As explained hereinafter, the front surfaces 44B of the posts 44 guide the lower contact carrier as it moves up and down between the picked up and dropped out positions.

Figure 4:
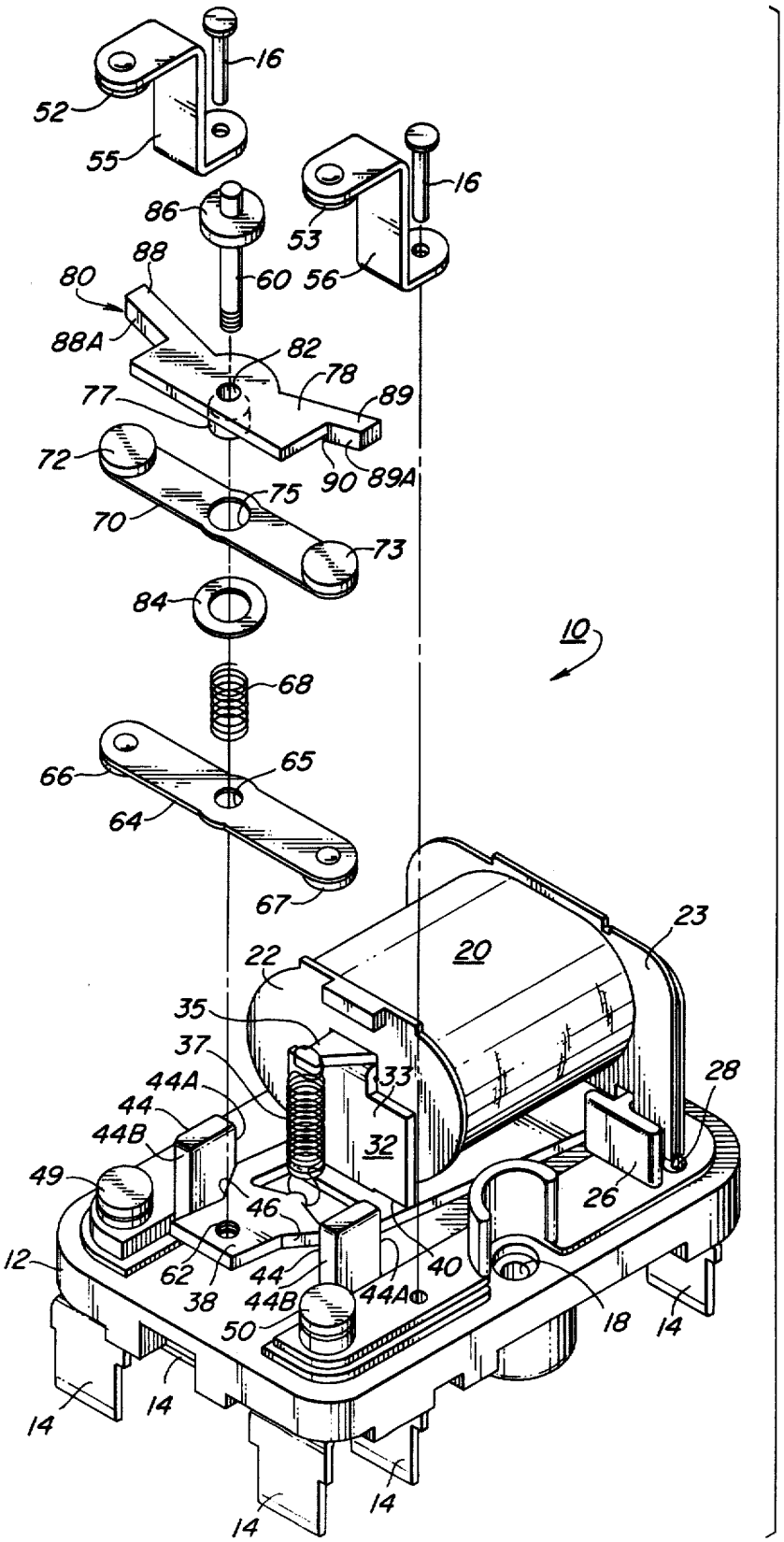
FIG. 4 is an exploded perspective view of the relay of FIG. 1.

A pair of fixed lower contacts 49 and 50 are mechanically and electrically connected to the respective front terminals 14, and a pair of fixed upper contacts 52 and 53 are mechanically and electrically connected to respective ones of a pair of metallic contact support brackets 55 and 56. As best shown in FIG. 4, the brackets 55 and 56 have apertured mounting flanges at the bottom which are electrically and mechanically connected to the intermediate terminals 14 by two of the rivets 16. It may be seen in FIGS. 1 and 2 that the upper contacts 52 and 53 are respectively aligned with the lower contacts 49 and 50.

A movable contact assembly is mounted between the upper and lower fixed contacts for vertical movement between upper and lower operating positions by the armature 38. Considered in greater detail, the movable contact assembly includes a contact carrier post 60 which is threadly secured at its lower end in an internally threaded opening 62 in the armature 38 forwardly of the fulcrum edges 40 about which the armature 38 pivots.

Slidably mounted on the post 60 is a lower contact carrier blade 64 having a hole 65 through which the post 60 loosely extends. The blade 64 is metallic and carries near its respective ends a pair of contacts 66 and 67. A compression type coil spring 68 surrounds the post 60 and seats against the top surface of the blade 64 to bias the contacts 66, 67 into respective engagement with the contacts 49, 50.

Figure 2:
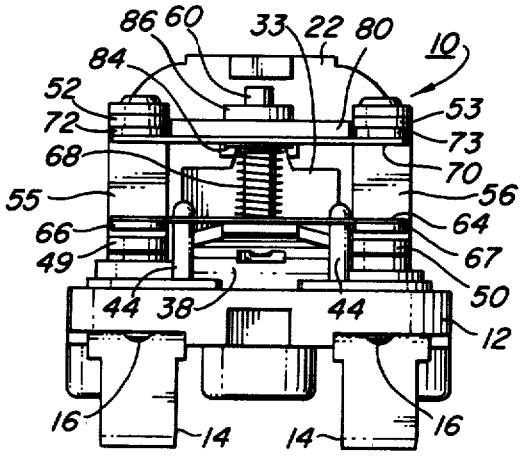
FIG. 2 is a front elevational view of the relay of FIG. 1.

An upper contact carrier blade 70, also formed of metal, carries near its respective ends a pair of contacts 72 and 73 which engage the contacts 52 and 53 when the coil 20 is deenergized and the post is in the up position as shown in FIGS. 1, 2 and 3. The contact carrier blade 70 has a central hole 75 which is loosely fitted onto a cylindrical boss 77 which is integral with and depends from the body portion 78 of a contact guide member 80. The member 80 has a cental hole 82 which receives the shank of the post 60. A washer 84 is press-fitted onto the boss 77 to hold the contact carrier blade 70 in assembled relationship with the guide member 80. The upper end of the spring 68 fits over the boss 77 and seats against the bottom surface of the washer 84 to bias the contact guide 80 against an integral, annular flange 86 on the lifter post 60. The contact guide member 80 and the washer 84 are formed of insulating materials such as plastic.

In order to prevent rotation of the contact carrier blade 70 relative to the brackets 55 and 56, which rotation could result in misalignment of the contacts 52, 53 and 72, 73, the contact guide 80 includes laterally extending arms 88 and 89 and a depending shoulder 90. The arms 88 and 89 are disposed in proximity to the front vertical surfaces of the brackets 55, 56 and have forwardly facing edge surfaces 88A and 89A which, with the shoulder 90, engage the blade 70 if it attempts to rotate in either direction.

It may thus be seen that the contact carrier blades are biased apart by the compression spring 68 thereby to assure a uniform contact pressure between the lower contacts 66, 67 and 49, 50 when the coil 20 is energized, and between the upper contacts 72, 73 and 52, 53 when the coil 20 is deenergized. Lateral movement of the armature and rotation of the lower contact carrier blade 64 is prevented by the integral posts 44 on the base, and rotation of the upper contact carrier blade 70 is prevented by the insulating contact guide 80 in cooperation with the brackets 55 and 56.

While the present invention has been described in connection with a particular embodiment thereof, it will be understood by those skilled in the art that many changes and modifications may be made without departing from the true spirit and scope of the present invention. Therefore, it is intended by the appended claims to cover all such changes and modifications which come within the true spirit and scope of this invention.

What is claimed is:

1. An electromagnetic relay comprising in combination, an insulating base member, an electromagnetic coil mounted on said base member, an armature means pivotally mounted to said base member with one end portion movable between upper and lower positions in response to the energization and denergization of said coil, spring means biasing said armature into one of said positions, a contact carrier post affixed to said one end portion of said armature and extending upwardly therefrom, first and second contacts mounted to said base on opposite sides of said armature, a lower contact carrier blade slidably mounted on said post and carrying a pair of contacts adapted to respectively engage said first and second contacts when said armature is in said lower position.

first and second upstanding abutment guide means integral with said base member and respectively disposed on opposite sides of said armature for limiting lateral movement thereof and for limiting rotational movement of said lower contact carrier blade, first and second contact carrier brackets mounted to said base and respectively carrying third and fourth contacts in spaced, vertical alignment with said first and second contacts, an upper contact carrier blade slidably mounted on said post and carrying a pair of upper contacts adapted to respectively engage said third and fourth contacts when said armature is in said upper position, and a compression spring compressed between said upper and lower contact carrier blades to urge said blades in mutually spaced apart relationship.

2. An electromagnetic relay according to claim 1, comprising a contact guide member formed of an insulating material and secured to said upper contact carrier blade for selective engagement with said contact carrier brackets to limit rotational movement of said upper contact carrier blade on said post.

3. An electromagnetic relay according to claim 2 wherein said contact guide member includes a cylindrical boss received in a central hole in said upper contact carrier blade, and a washer press-fitted on said boss to hold said upper contact carrier blade and said contact guide member in mutually assembled relationship.

4. An electromagnetic relay according to claim 3 wherein said compression spring is a coil spring, and the upper end portion of said compression spring is disposed over the lower end portion of said boss.

5. An electromagnetic relay according to claim 2 wherein said contact guide member includes outwardly extending arms respectively interposed between said contact carrier brackets and said pair of upper contacts.

* * * * *